US009093256B2

(12) United States Patent
Muelders

(10) Patent No.: US 9,093,256 B2
(45) Date of Patent: Jul. 28, 2015

(54) DISCHARGE LAMP

(75) Inventor: Barbara Roswitha Muelders, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/348,082

(22) PCT Filed: Sep. 14, 2012

(86) PCT No.: PCT/IB2012/054787
§ 371 (c)(1),
(2), (4) Date: Mar. 28, 2014

(87) PCT Pub. No.: WO2013/046085
PCT Pub. Date: Apr. 4, 2013

(65) Prior Publication Data

US 2014/0232260 A1 Aug. 21, 2014

Related U.S. Application Data

(60) Provisional application No. 61/541,419, filed on Sep. 30, 2011.

(51) Int. Cl.

| | |
|---|---|
| ***H01J 61/06*** | (2006.01) |
| ***H01J 9/02*** | (2006.01) |
| ***H01J 61/073*** | (2006.01) |
| ***H01J 61/36*** | (2006.01) |

(52) U.S. Cl.
CPC . *H01J 61/06* (2013.01); *H01J 9/02* (2013.01); *H01J 61/0732* (2013.01); *H01J 61/368* (2013.01)

(58) Field of Classification Search
None
See application file for complete search history.

(56) References Cited

U.S. PATENT DOCUMENTS

| | | | | |
|---|---|---|---|---|
| 6,762,557 | B2 | 7/2004 | Kanzaki | |
| 6,861,806 | B2 * | 3/2005 | Kumada et al. | 313/623 |
| 2007/0103081 | A1 | 5/2007 | Boroczki | |
| 2008/0185950 | A1 | 8/2008 | Claus | |
| 2008/0203920 | A1 * | 8/2008 | Wang et al. | 313/634 |
| 2009/0021172 | A1 * | 1/2009 | Graser et al. | 313/623 |
| 2009/0295290 | A1 * | 12/2009 | Magai | 313/623 |
| 2010/0270921 | A1 * | 10/2010 | Shirakawa et al. | 313/623 |
| 2010/0295448 | A1 * | 11/2010 | Takagaki et al. | 313/623 |
| 2010/0295449 | A1 | 11/2010 | Shido | |
| 2011/0025203 | A1 | 2/2011 | Hirao | |
| 2012/0256539 | A1 * | 10/2012 | Muelders et al. | 313/623 |

FOREIGN PATENT DOCUMENTS

| | | | |
|---|---|---|---|
| JP | 2010287359 | A | 12/2010 |
| WO | 2008119375 | A1 | 10/2008 |
| WO | 2011073862 | A1 | 6/2011 |

* cited by examiner

*Primary Examiner* — Ashok Patel

(57) ABSTRACT

The invention describes a discharge lamp (1) comprising a quartz glass envelope (10), a discharge chamber (11) and a pair of electrodes (2), wherein an outer end portion (2A) of an electrode (2) overlaps a conductive foil (3) embedded in a pinch (12) of the quartz glass envelope (10), and wherein the electrode (2) comprises an inner structured zone (ZB) in an inner portion (2B) of the electrode (2) between the conductive foil (3) and the discharge chamber (11), and an outer structured zone (ZA) over the outer end portion (2A) of the electrode (2), and wherein the outer structured zone (ZA) and the inner structured zone (ZB) are different from each other. The invention also describes a method of manufacturing an electrode (2) for use in a discharge lamp (1). The invention further describes an electrode (2) for use in a discharge lamp (1).

18 Claims, 4 Drawing Sheets

DISCHARGE LAMP

CROSS-REFERENCE TO PRIOR APPLICATIONS

This application is the U.S. National Phase application under 35 U.S.C. §371 of International Application No. PCT/IB2012/054787, filed on Sep. 14, 2012, which claims the benefit of U.S. Provisional Patent Application No. 61/541,419, filed on Sep. 30, 2011. These applications are hereby incorporated by reference herein.

FIELD OF THE INVENTION

The invention describes a discharge lamp, an electrode for such a lamp, and a method of manufacturing an electrode for such a lamp.

BACKGROUND OF THE INVENTION

During operation of a gas-discharge lamp such as a high-intensity discharge lamp, the high temperatures of the electrodes embedded in the pinch regions lead to correspondingly high levels of stress owing to the different rates of expansion and contraction of the quartz glass and the electrodes, which are usually made of tungsten. These stresses lead to the development of cracks, of which there are several different kinds For example, cracks can develop in a region close to the discharge chamber, or in a region between the electrode and a molybdenum foil embedded in the pinch, or close to the cut end of the pinch at the point where the body of the lamp is detached from a carrier quartz body in a final manufacturing step, referred to as "cutting-edge cracks", etc. Much effort has been invested in lamp designs that strive to minimize the development of cracks, since these can lead to lamp failure. For example, some designs include longitudinal grooves along the outer surface of the electrode in the region enclosed within the pinch. These grooves should prevent the development of cracks close to the discharge chamber, where the temperature of the electrode is highest. Other designs deliberately leave a gap between the quartz and the electrode body so that the electrode can freely expand and contract. Alternatively, some designs make use of a "hairbrush" structuring in a region of the electrode close to the discharge chamber, to counteract the high temperatures nearer the discharge end of the electrode and to discourage the development of a radially extending crack (REC) that would lead to the failure of the lamp. However, any structuring carried out on the surface of the electrode may compromise its mechanical flexibility and capacity to deform, and excessive structuring may in turn lead to electrode failure.

Another type of crack may develop close to the end of the electrode and is referred to as an "end-of-electrode crack" (EEC). An EEC typically travels axially from a point near the base or outer end face of the electrode, in a region where the electrode is bonded to a conductive foil, towards the outer end of the pinch. An EEC typically has a curved shaped in the manner of a flat parabola. The development of such EECs is not yet fully understood. There may be different causes that trigger the development of such a crack. Stress in the pinch during operation of the lamp, particularly an inhomogeneous stress distribution is believed to be a major contributing factor and can promote or accelerate EEC growth. The inhomogeneous stress distribution could be a result of variations in material interactions. In any case, it may be assumed that some kind of nucleus encourages an EEC to develop. Such a "nucleus" could be generated by different mechanisms, it could be induced chemically or mechanically, e.g. by an impurity in the quartz glass in the region around the conductive foil, or by a "micro-crack" that has developed in that region as a result of an unfavourable distribution of thermally-induced tensile and compression stresses. Alternatively, a cutting-edge crack may act as a nucleus to trigger an end-of-electrode crack. Regardless of the mechanics of its development, once an EEC appears, lamp failure is imminent, so that it is of great importance to inhibit its development in the first place.

Therefore, it is an object of the invention to provide an improved electrode design that avoids the development of an end-of-electrode crack.

SUMMARY OF THE INVENTION

The object of the invention is achieved by the discharge lamp of claim 1, by the electrode of claim 12, and by the method of claim 13 of manufacturing such an electrode.

According to the invention, the discharge lamp comprises a quartz glass envelope, a discharge chamber and a pair of electrodes, wherein an outer end portion of an electrode overlaps a conductive foil embedded in a pinch of the quartz glass envelope, and wherein the electrode comprises an inner structured zone in an inner or intermediate portion of the electrode between the conductive foil and the discharge chamber, and an outer structured zone over the outer end portion of the electrode, and wherein the outer structured zone and the inner structured zone are—physically and/or spatially—distinct and different from each other. As described in the introduction, an axial or end-of-electrode crack travels from the outer end of the electrode to the outer end of the pinch, in contrast to an REC, which travels radially outward from an inner portion of the electrode. The outer structured zone is formed close to the outer extremity of the electrode since an EEC typically originates in that area and extends towards the outer tip or extremity of the pinch, as explained in the introduction. The inner or intermediate structured zone can be formed symmetrically about the middle of the electrode, or can be displaced relative to the electrode middle, where it can act, for example, to inhibit or prevent the development of RECs.

An advantage of the discharge lamp according to the invention is that the outer structured zone effectively reduces the stress level in the pinch by deliberate initiation of small "releasing" cracks or "micro-cracks" in a specific region of the quartz glass pinch. These micro-cracks can be deliberately encouraged to develop, as a result of the differences in thermal expansion coefficient of the material of the electrode and the quartz glass in combination with the effect of the outer structured zone, for example during the process of forming the pinch. Without the outer structured zone, i.e. in a prior art lamp, any impurity or excessive strain in that region of the pinch might act as a nucleus from which an EEC might develop. The outer structured zone serves to deliberately trigger the growth of microscopically small cracks in a specific region where they serve to allow the electrode and quartz to expand and contract at their different rates during subsequent switching cycles of the lamp. The stress level in that critical region of the pinch is therefore very effectively reduced, so that the risk of an EEC developing is effectively eliminated.

The outer structured zone and the inner structured zone are spatially and/or physically distinct, for example they can be formed in different ways to different effect, so that the inner structured zone serves to inhibit the development of RECs while the outer structured zone serves to inhibit the development of EECs. In this way, the different problems, namely development of different types of crack, can be optimally solved.

According to the invention, the electrode for use in a discharge lamp comprises an inner structured zone in an inner portion of the electrode, which inner portion will be embedded in a pinch of the discharge lamp between a conductive foil and a discharge chamber of the lamp; and an outer structured zone formed over an outer end portion of the electrode that will overlap the conductive foil when embedded in the pinch, wherein the outer structured zone is distinct, i.e. spatially and/or physically different, from the inner structured zone.

An advantage of the electrode according to the invention is that mechanical flexibility and deformation capacity of the electrode are not affected to any significant degree by the outer structured zone, which is restricted to only a small fraction of the overall length of the electrode, so that the outer structured zone does not have any significant negative effect on the performance of the electrode during operation of the lamp. Another advantage of such an electrode is that it can be used in any discharge lamp in which the problem of EECs would otherwise lead to a shortened lamp lifetime. Since the outer structured zone of the electrode is mainly in the region that will overlap a conductive foil, any other structuring over other regions of the electrode can be performed as usual, so that the electrode can be used in a wide variety of discharge lamps, while the distinct and different inner and outer structured zones act to inhibit the different types of crack that might originate in those zones.

According to the invention, the method of manufacturing an electrode for use in a discharge lamp comprises the steps of forming an inner structured zone in an inner portion of the electrode to be embedded in a pinch of the discharge lamp between a conductive foil and a discharge chamber of the lamp; and forming an outer structured zone over an outer end portion of the electrode, which outer end portion will overlap the conductive foil when embedded in the pinch, such that the outer structured zone is distinct and different from the inner structured zone.

An advantage of the method according to the invention is that the forming of the outer structured zone is simple to perform, as will become clear in the following, and does not involve any complicated steps. Furthermore, the method according to the invention can be carried out in conjunction with or independently of other processing steps to treat other regions of the electrode.

The dependent claims and the following description disclose particularly advantageous embodiments and features of the invention. Features of the embodiments may be combined as appropriate. Features described in the context of one claim category can apply equally to another claim category.

In the following, for the sake of simplicity but without restricting the invention in any way, the material of the electrode may be assumed to be tungsten, and the part of the electrode body embedded in the pinch may be assumed to be essentially rod-shaped. Furthermore, again without restricting the invention in any way, the conductive foil may be assumed to comprise a Molybdenum foil (usually referred to simply as a "Mo-foil"). For consistency, the "tip" of the electrode is that end of the electrode from which a discharge arc extends, while the "outer end" is that end which is bonded or otherwise connected to the Mo-foil in the pinch. Since a HID discharge lamp of the type discussed herein is often used in automotive uses, it may be assumed in the following, again without restricting the invention in any way, that the discharge lamp comprises an automotive HID lamp such as a D4 lamp.

The lamp and electrode according to the invention have been developed as the result of observations made regarding the nature of the EEC development in a HID lamp. Using advanced diagnostic techniques, the inventors reached the conclusion that the development of an EEC is made likely when a micro-crack is allowed to develop in an uncontrolled manner in a critical region near the base of the electrode, for example in the region about a bond between the Mo-foil and the outer end of the electrode, since a build-up of stress in that region can be "offloaded" and channeled through such an uncontrolled micro-crack. In the lamp according to the invention, micro-cracks are deliberately "farmed" in specific, defined regions about the outer end of the electrode where these farmed micro-cracks can exert a positive influence by reducing stresses in the quartz glass matrix. In other words, the farmed micro-cracks that develop around the electrode in a lamp according to the invention actually act to reduce or prevent the development of EECs, since they effectively prevent the dangerous build-up of stress in that critical or vulnerable region of the lamp.

In the lamp according to the invention, the outer structured zone of the electrode acts to interrupt the adhesion between the metal of the electrode and the quartz glass. Also, the outer structured zone of the electrode alters the distribution of tensile and compression stresses in that area. The effectiveness of the outer structured zone in suppressing the development of EECs lies in a combination of the local interruption of the surface adhesion due to a specific distribution of tensile and compression stresses that arises as a result of the outer structured zone. The lamp according to the invention therefore preferably comprises an artificial elastic interface between a surface of the electrode in the outer structured zone and the quartz glass of the pinch, which artificial elastic interface comprises a number, preferably a plurality, of deliberately grown or "farmed" micro-cracks. The formation of these farmed micro-cracks about the outer end of the electrode can be provoked during the pinch process, as the quartz glass (and therefore also the metal electrode) is heated to a high temperature to embed the electrode in the pinch. This artificial elastic interface or artificial "bond coat" allows the electrode to move relatively freely during thermally induced expansion and contraction during any subsequent operation of the lamp, with the result that an EEC is unlikely to develop.

A structured zone to influence the interaction between the metal of the electrode and the quartz can be formed in a number of ways. For example, a coating can be applied to the outer surface of the electrode in order to obtain a desired interaction at the tungsten/quartz junction. Alternatively or in addition, a thin wire or coil can be wrapped about the body of the electrode to obtain a structured zone, or small particles can be deposited on the surface of the electrode. The inventors tested various types of structuring to determine an optimal type that would have a minimal influence on desirable factors such as deformability, and conclude that, in a preferred embodiment of the invention, a structured zone comprises a number of recesses formed in the surface of the electrode. In the case of an outer structured zone for inhibiting EECs, such recesses interrupt to a sufficient extent the surface adhesion between the quartz glass and the metal of the electrode in that region, and are not so deep as to compromise the mechanical stability of the electrode.

As indicated above, there are various ways of treating an electrode in order to avoid the development of other types of cracks such as bead cracks or RECs. These are more likely to develop on account of the high levels of thermally related stresses around the body of the electrode in an inner region of the pinch, i.e. the region between the discharge chamber and the Mo-foil. Therefore, in a particularly embodiment of the lamp according to the invention, the inner structured zone is formed over a region of the electrode between the conductive foil and the discharge chamber, which inner structured zone is realized to inhibit the development of a radially extending crack in the quartz glass envelope. For example, the inner or central structured zone can comprise a "hairbrush" region in which deeper channels are formed around the body of the electrode, with or without additional protrusions, spikes or "tufts" of electrode material extending into the quartz glass matrix. A lamp with such an electrode is described in WO 2011/073862 A1, and is incorporated herein by reference. Preferably, such an inner structured zone comprises two separate hairbrush zones arranged about the middle of the electrode, i.e. on either side of a "half-way point" along the electrode.

The intermediate structured zone and the outer structured zone can be formed directly adjacent to one another, i.e. without any significant intervening space, or may be separated by an unstructured or essentially unaltered, portion of the electrode.

As indicated above, it is important that any structuring of the electrode does not compromise or detract from the ability of the electrode to deform during operation. In various experiments, the inventors analysed the effects of different types of outer structured zone using various recess depths. The inventors conclude that the depth of a recess in an outer structured zone preferably comprises at most 2.0%, more preferably at most 0.8%, most preferably at most 0.25% of a diameter of the electrode in the outer structured region. Since the recesses are so shallow in the outer structured zone, this can also be referred to as a "micro-hairbrush zone".

A recess can be understood to be any kind of dent or indentation in the surface of the electrode extending into the body of the electrode. In a particularly preferred embodiment of the invention, a recess in a structured zone comprises a channel or groove formed in the body of the electrode. In experiments carried out during development of the invention, it has been observed that micro-crack development depends to some extent also on the orientation of such channels or grooves formed on the surface of the electrode. In a further preferred embodiment of the invention, a recess in the outer structured zone comprises a radial channel formed about the electrode, whereby the term "radial" is to be interpreted in the context of "moving along a radius" or "developing uniformly about the longitudinal axis of the electrode". Such an arrangement was shown to be very effective, with a significant decrease in the development of EECs compared to reference lamps. Such a channel can be formed relatively easily by directing a forming tool at the electrode while simultaneously rotating the electrode about its longitudinal axis. Several essentially parallel channels can be formed in this way, separated by an untreated region or band of a desired width. In a particularly preferred embodiment of the invention, the radial channel comprises a helical channel formed about the body of the electrode, so that the structured zone can be formed in a single step. Such a helical channel can be achieved by directing a forming tool at the electrode while simultaneously rotating the electrode about its longitudinal axis as well as displacing the electrode along that axis.

The outer structured zone is proven effective in the suppression or avoidance of EECs. Since these develop primarily in the outer extremity of the pinch, the outer structured zone is preferably confined to the outer end of the electrode, i.e. to the end of the electrode in the region of the Mo-foil. Therefore, in a further preferred embodiment of the invention, the length of a outer structured zone preferably comprises at most 20%, more preferably at most 10%, most preferably at most 5% of the overall embedded length of the electrode. The outer structured zone need only be formed over a small part of the overall embedded length of the electrode.

The channels or grooves can be formed using any suitable technique. In a particularly preferred embodiment of the invention, the step of forming an outer structured zone comprises removing material from the body of the electrode to form a number of shallow channels around the body of the electrode. For example, the channels could be milled using an appropriate milling tool capable of removing a shallow layer of material from around the body of the electrode. However, such a mechanical approach may result in a weakening of the electrode, since the material of the electrode is generally quite brittle and such a mechanical approach would of necessity involve the use of force. Therefore, in a further embodiment of the invention, a channel is preferably formed by directing a laser beam at the surface of the electrode to remove material of the electrode. The laser beam is preferably generated such that material is only removed up to the desired depth of the channel. Preferably, the electrode is rotated while the laser beam is being directed at the electrode, so that a channel is formed some or all of the way around the body of the electrode. The electrode and/or laser can simultaneously be moved laterally so that a helical channel is formed in the surface of the electrode. The use of a laser beam to form the channel has a number of advantages. For example, the laser can be configured very precisely, so that a favourably shallow channel can easily be formed.

The extent of the outer structured zone may depend on various factors such as the electrode diameter, the thickness of the pinch, the length of the electrode and the geometry of the inner structured zone, etc. A lamp with a relatively thick electrode or a lamp in which the pinch temperature exceeds 2000° C. during the pinching process may be particularly susceptible to EECs. Therefore, in a further preferred embodiment of the invention, the outer structured zone extends beyond the overlap region. For example, the outer structured zone can extend beyond the Mo-foil, i.e. in the direction of the inner end of the electrode, to a few percent of the overall embedded length. For other electrode and/or lamp types, an outer structured zone may be essentially contained with the outer end region, i.e. within the overlap region in which the electrode overlaps the conductive foil. The outer structured zone can extend to the very outer end of the electrode, i.e. all the way to the base of the electrode. However, in a further preferred embodiment of the invention, the electrode comprises an untreated portion between its base (i.e. the outer end face of the electrode) and the outer structured portion. For example, for an electrode that is 8.0 mm in length, the outer end portion of the electrode—where it overlaps the conductive foil—may comprise 1.0 mm. In this example, the outer structured zone may commence at 0.3 mm from the outer end of the electrode and extend over 1.3 mm in the direction of the discharge vessel.

Equally, the lamp according to the invention comprises an electrode with two or more outer structured zones, i.e. one outer structured zone can be contained entirely within the overlap region, and a second outer structured zone can also be contained entirely within the overlap region or can extend beyond the overlap region in the direction of the discharge vessel.

Some kinds of electrodes may be more likely to encourage the development of EECs in the lamp in which they are incorporated. If the electrodes are treated to include such an outer structured region, the likelihood of EEC development can be greatly reduced or even eliminated. For example, in tests with amplifying conditions deliberately chosen to provoke the development of cracks, two batches of the same lamp type were tested, a first batch comprising lamps according to the invention, i.e. lamps with electrodes having an outer structured zone, and a second batch of reference lamps, i.e. prior art lamps without such an outer structured zone. In the first batch comprising lamps according to the invention, no EECs at all were observed. In the second batch, more than 2% of the lamps failed due to the development of an end-of-electrode crack. The lamp according to the invention is therefore particularly suited for use as a HID lamp in an automotive front lighting application, where a reliably long lifetime is highly desirable.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
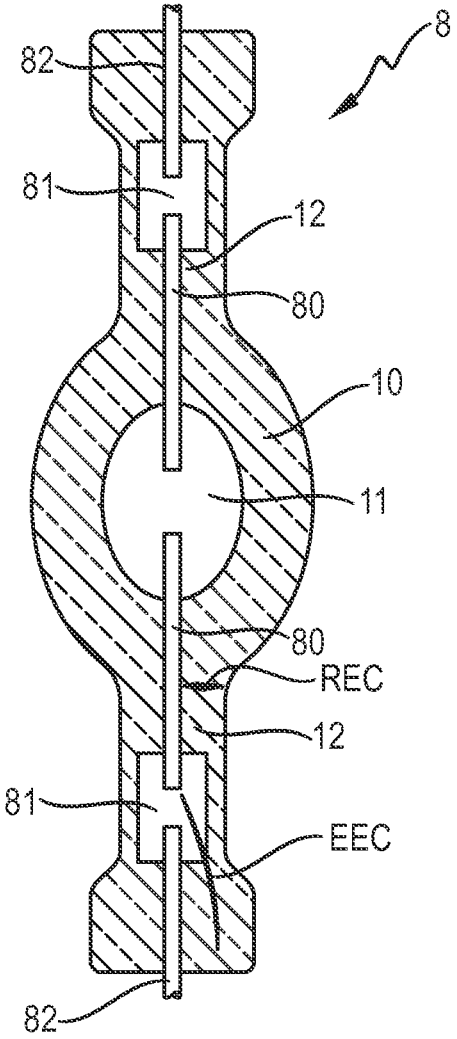
FIG. 1 (prior art)
FIG. 1 shows a schematic representation of a prior art gas-discharge lamp.

FIG. 1 shows a simplified schematic representation of a prior art gas-discharge lamp 8, such as an automotive HID lamp, illustrating the development of cracks REC, EEC. The lamp 8 comprises a quartz glass envelope 10 and a pair of electrodes 80 extending into a discharge vessel 11. Each electrode 80 is partially embedded in a pinch 12 and bonded at its outer end to a Mo-foil 81, which in turn is bonded to an outer lead 82. During operation of the lamp, the electrodes 80 become very hot and expand. The quartz glass is also heated as a result, and also expands. When the lamp 8 is turned off again, the electrodes 80 cool and contract, as does the quartz glass. The thermal rates of expansion and contraction are very different for the electrode 80 (usually tungsten) and quartz glass, leading to tensile and compression stresses in the quartz glass envelope matrix. Over time, as a result of the repeated stress in the quartz glass, a radially extending crack REC can form in the quartz glass around the part of the electrode 80 between the foil 81 and the discharge vessel 11, since that is the hottest part of the embedded electrode 80. At the outer end of the electrode 80, an end-of-electrode crack EEC can form, and typically has a flattened curved shape extending from the base of the electrode 80 towards the outer extremity of the pinch 12. These cracks EEC, REC form spontaneously and lead to lamp failure.

While the lamp design of WO 2011/073862 A1 can effectively counteract or inhibit the growth of RECs, the inner structured region or "hairbrush region" cannot prevent the occurrence of an EEC, owing to the different stress distribution at the outer end of the electrode.

Figure 2:
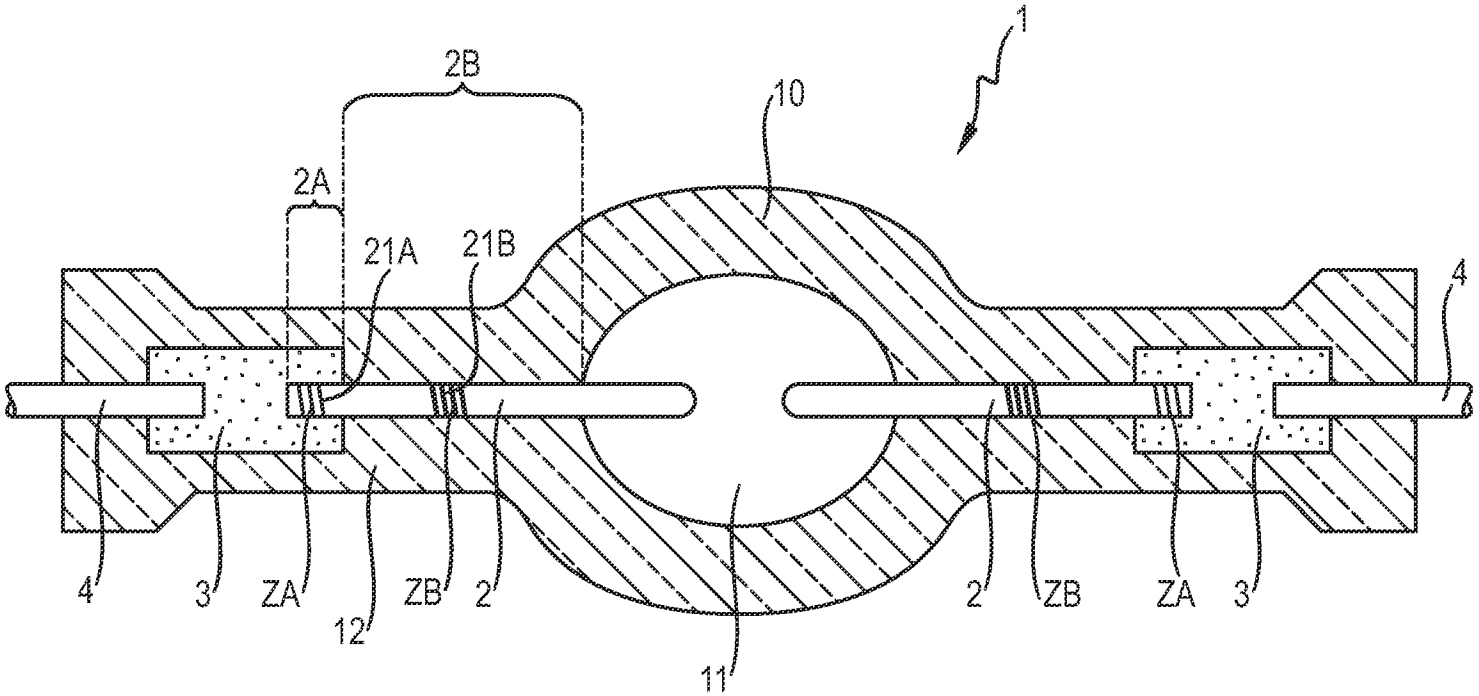
FIG. 2 is a schematic representation of an HID lamp according to a first embodiment of the invention.
Figure 3:
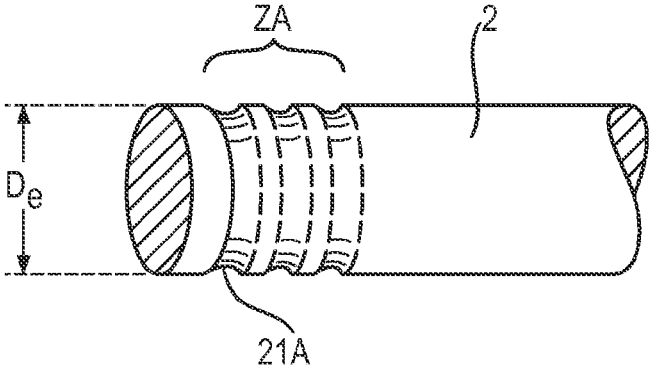
FIG. 3 shows a detail of the outer end of an electrode according to a first embodiment of the invention.

FIG. 2 shows a simplified schematic representation of an HID lamp 1 according to the invention. Its construction is largely the same as for the prior art lamp 8 shown in FIG. 1 above, i.e. the lamp 1 comprises a quartz glass body 10 enclosing a discharge vessel 11, and a pair of electrodes 2 arranged to face each other in the discharge vessel 11 across a short gap. An electrode 2 can be virtually divided into a number of regions, namely an outer end portion 2A, an inner portion 2B, and a remaining tip portion. The greater part 2A, 2B of each electrode 2 is embedded in a pinch 12. The outer end portion 2A of each electrode 2 is bonded to a conductive foil 3, which in turn is also bonded to an outer lead 4. According to the invention, an outer structured zone ZA is formed over at least a portion of the electrode outer end 2A. The inner structured zone ZB comprises a hairbrush structuring in the manner of channels 21B formed helically about the surface of an intermediate region of the electrode 2, whereby the effectiveness of these channels 21B in preventing radially extending cracks can be augmented by protrusions extending into the quartz glass matrix. The outer structured zone ZA can comprise shallow channels 21A, i.e. channels 21A that are shallow compared to the channels 21B of the inner structured zone ZB, arranged about the circumference of the electrode body, as shown in FIG. 3, which shows a detail of the outer end 2A of an electrode 2 according to a first embodiment of the invention. The diagram shows the outer structured zone ZA close to the outer edge of the electrode 2. The outer structured zone ZA comprises a number of shallow channels, recesses or grooves 21A formed at least partially about the body of the electrode 2. For example, the channels 21A could extend all the way around the body of the electrode 2, or they may be formed only over the surface of the electrode 2 that is not welded to the conductive foil. The outer structured zone ZA can comprise a plurality of distinct channels 21A, or can comprise a single channel 21A formed over the body of the electrode 2 in a helical fashion. The depth of the channels 21A is exaggerated here for the purposes of illustration. In reality, a channel 21A is very shallow, and extends into the body of the electrode 2 to only a small extent, e.g. 0.5% of the electrode diameter $D_e$ where it is to be welded or bonded to the conductive foil.

Figure 4:
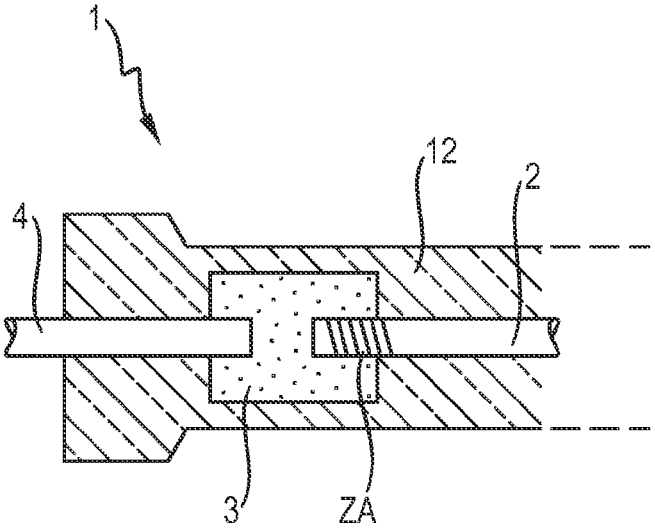
FIG. 4 shows a detail of an HID lamp according to a second embodiment of the invention.

FIG. 4 shows a detail of an HID lamp 1 according to a second embodiment of the invention. Here, an outer structured zone ZA is formed on the body of the electrode 2 to extend beyond the outer end portion 2A in the direction of the discharge vessel. Here, the slanted orientation of the channels 21A indicates that these can be formed in a helical manner, so that the outer structured zone ZA can effectively comprise a single helical channel 21A extending several times about the body of the electrode 2.

Figure 5:
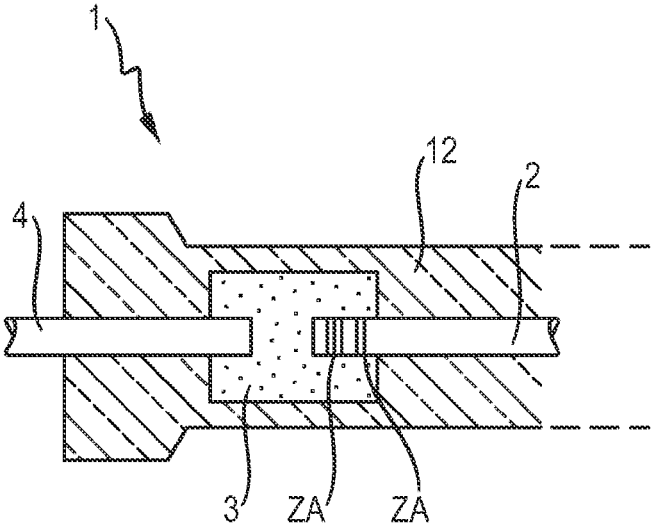
FIG. 5 shows a detail of an HID lamp according to a third embodiment of the invention.

FIG. 5 shows a detail of an HID lamp 1 according to a third embodiment of the invention. Here, two outer structured zones ZA are formed on the body of the electrode 2 within the overlap region where the electrode 2 overlaps the conductive foil 3.

Figure 6:
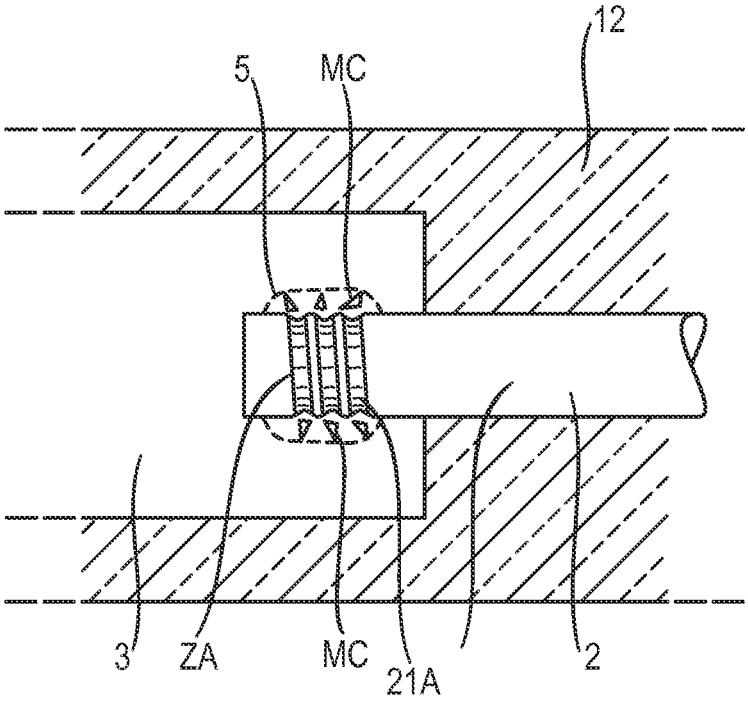
FIG. 6 shows a detail of the lamp of FIG. 2, schematically illustrating the beneficial effect of the outer structured zone.

FIG. 6 shows a detail of the lamp of FIG. 2, schematically illustrating the beneficial effect of the outer structured zone ZA. In the manufacturing process, the quartz glass that will form the pinch must be heated to a very high temperature in order to be able to deform the glass so that the outer lead, Mo-foil and electrode are embedded in a hermetic seal. Once the pinch is formed, the quartz glass and electrode cool again. The distribution of stresses in the quartz glass matrix about the outer end of the electrode, in conjunction with the outer structured zone ZA, leads to the formation of microscopically small cracks MC about the end of the electrode 2. The microcracks MC are encouraged to develop by the interruption of the surface contact between the quartz glass and the electrode 2 caused by the shallow channels 21A of the outer structured zone ZA. For the sake of clarity, in this plan view the micro-cracks are only shown along the outer edges of the electrode 2, but it will be understood that the micro-cracks MC can be distributed essentially evenly in the quartz glass matrix about the outer structured zone ZA. This layer of "farmed" micro-cracks, indicated in the diagram by the broken line, effectively provides an artificial or virtual elastic interface 5 between the surface of the outer end of the electrode and the quartz glass of the pinch and are directly related to a reduction in stress in this region of the pinch 12, so that an end-of-electrode crack is far less likely to develop. In other words, instead of allowing other micro-cracks to form randomly in any EEC-critical part of the quartz glass matrix, these micro-cracks MC are deliberately "farmed" about the electrode outer end 2A, where they act as an artificial bond coat between the electrode surface and the quartz glass. Later, when the lamp undergoes repeated operation cycles during its normal lifetime, this artificial elastic interface prevents the build-up of an unfavourable distribution of tensile and compression stresses in that region of the quartz glass matrix, so that an EEC is effectively inhibited or prevented from developing.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A discharge lamp comprising a quartz glass envelope, a discharge chamber and a pair of electrodes, wherein an outer end portion of an electrode overlaps a conductive foil embedded in a pinch of the quartz glass envelope, and an inner portion of the electrode extends between the conductive foil and the discharge chamber, wherein the outer end portion and the inner portion do not overlap;

the discharge lamp further comprising an outer structured zone positioned over at least part of the outer end portion of the electrode, and an inner structured zone positioned over the inner portion of the electrode; and, wherein the electrode has a surface and each structured zone comprises a number of recesses formed in the surface of the electrode.

2. A lamp according to claim 1, wherein the length of the outer structured zone comprises at most 5% of the overall embedded length of the electrode.

3. A lamp according to claim 1, wherein the depth of a recess in the outer structured zone comprises at most 2.0% of a diameter ($D_e$) of the electrode.

4. A lamp according to claim 1, wherein a recess in the outer structured zone is bounded by an essentially unaltered electrode surface region.

5. A lamp according to claim 1, wherein a structured zone comprises a radial channel formed about the electrode.

6. A lamp according to claim 5, wherein the radial channel comprises a helical channel formed about the body of the electrode.

7. A lamp according to claim 1, wherein the outer structured zone extends beyond the outer end portion.

8. A lamp according to claim 1, wherein the length of the outer structured zone comprises at most 20% of the overall embedded length of the electrode.

9. A lamp according to claim 1, comprising an unstructured electrode region between the outer structured zone and the inner structured zone.

10. A lamp according to claim 1, comprising an unstructured electrode region between the outer structured zone and an end of the electrode distal from the discharge chamber.

11. A lamp according to claim 1, comprising an artificial elastic interface between a surface of the electrode in the outer structured zone and the quartz glass of the pinch.

12. A lamp according to claim 1, wherein the depth of a recess in the outer structured zone comprises at most 0.8% of a diameter ($D_e$) of the electrode.

13. A lamp according to claim 1, wherein the depth of a recess in the outer structured zone comprises at most 0.25% of a diameter ($D_e$) of the electrode.

14. A lamp according to claim 1, wherein the length of the outer structured zone comprises at most 10% of the overall embedded length of the electrode.

15. An electrode suitable for use in a discharge lamp, which electrode has a surface and comprises an inner structured zone in an inner portion of the electrode, which inner portion will be embedded in a pinch of the discharge lamp between a conductive foil and a discharge chamber of the lamp;

an outer structured zone formed over an outer end portion of the electrode that will overlap the conductive foil when embedded in the pinch; and, wherein each structured zone comprises a number of recesses formed in the surface of the electrode.

16. A method of manufacturing an electrode having a surface and suitable for use in a discharge lamp, which method comprises the steps of forming an inner structured zone in an inner portion of the electrode to be embedded in a pinch of the discharge lamp between a conductive foil and a discharge chamber of the lamp;

forming an outer structured zone over an outer end portion of the electrode, which outer end portion will overlap the conductive foil when embedded in the pinch; and, wherein each structured zone comprises a number of recesses formed in the surface of the electrode.

17. A method according to claim 16, wherein the step of forming a structured zone comprises removing material from the body of the electrode to form a number of recesses in the body of the electrode.

18. A method according to claim 17, wherein a recess is formed by directing a laser beam at the surface of the electrode to remove material of the electrode.

* * * * *